US011346131B2

(12) United States Patent
Tsui

(10) Patent No.: US 11,346,131 B2
(45) Date of Patent: May 31, 2022

(54) ELECTRONIC LOCK AND LIGHT COLOUR CONTROL METHOD FOR SAME

(71) Applicant: INNOVA IDEAS LIMITED, Hong Kong (HK)

(72) Inventor: Paul Yeung On Tsui, Hong Kong (HK)

(73) Assignee: INNOVA IDEAS LIMITED, Hong Kong (HK)

( * ) Notice: Subject to any disclaimer, the term of this patent is extended or adjusted under 35 U.S.C. 154(b) by 396 days.

(21) Appl. No.: 16/478,943

(22) PCT Filed: Dec. 21, 2017

(86) PCT No.: PCT/IB2017/058241
§ 371 (c)(1),
(2) Date: Jul. 18, 2019

(87) PCT Pub. No.: WO2018/134663
PCT Pub. Date: Jul. 26, 2018

(65) Prior Publication Data

US 2021/0047865 A1 Feb. 18, 2021

(30) Foreign Application Priority Data

Jan. 20, 2017 (CN) ..... 201710051805.2

(51) Int. Cl.
*E05B 67/22* (2006.01)
*E05B 41/00* (2006.01)
(Continued)

(52) U.S. Cl.
CPC ..... *E05B 67/22* (2013.01); *E05B 41/00* (2013.01); *E05B 47/0603* (2013.01);
(Continued)

(58) Field of Classification Search
CPC ..... E05B 41/00; E05B 47/0012; E05B 47/06; E05B 47/0603; E05B 49/00; E05B 67/06;
(Continued)

(56) References Cited

U.S. PATENT DOCUMENTS 6,401,501 B1 * 6/2002 Kajuch ..... E05B 67/22 63/38
7,948,359 B2 * 5/2011 Marcelle ..... E05B 67/24 340/5.64

(Continued)

*Primary Examiner* — Christopher J Boswell
(74) *Attorney, Agent, or Firm* — Browdy and Neimark, PLLC

(57) ABSTRACT

Disclosed are an electronic lock (100) and a light colour control method for the electronic lock (100). The electronic lock (100) comprises a lock body (1), a lock hook (2), at least two shifting beads (3), a lock shifter (4), a motor (5), a motor actuator (6), and an elastic member (7), wherein the shifting beads (3), the lock shifter (4), the motor (5) and the motor actuator (6) are mounted in the lock body (1), the motor actuator (6) is mounted on the motor (5) and interlinked with the lock shifter (4), the lock hook (2) is mounted on the lock body (1) and is able to move with respect to the lock body (1), the shifting beads (3) cooperate with the lock hook (2) such that the electronic lock (100) is transformable between a locked state and an unlocked state, and the elastic member (7) is mounted in the lock body (1) and exerts an acting force on the shifting beads (3) in opposite directions towards the lock hook (2) so that the shifting beads (3) do not exert any acting force on the lock shifter (4) during a progress of unlocking and locking. In the electronic lock (100), the shifting beads (3) do not exert any acting three on the motor (5) during a progress of unlocking and locking, and the motor (5) is in an unloaded state, thereby lowering demand for power supply and for the voltage and power of the motor (5), reducing energy loss and prolonging the service life of the electronic lock.

15 Claims, 15 Drawing Sheets

(51) Int. Cl.

| | |
|---|---|
| ***E05B 49/00*** | (2006.01) |
| ***E05B 47/00*** | (2006.01) |
| ***E05B 67/38*** | (2006.01) |
| ***E05B 47/06*** | (2006.01) |

(52) U.S. Cl.
CPC ..... *E05B 49/00* (2013.01); *E05B 67/38* (2013.01); *E05B 2047/0016* (2013.01); *E05B 2047/0024* (2013.01); *E05B 2047/0037* (2013.01); *E05B 2047/0095* (2013.01); *E05Y 2201/434* (2013.01); *E05Y 2201/484* (2013.01); *E05Y 2400/612* (2013.01); *E05Y 2400/85* (2013.01)

(58) Field of Classification Search
CPC .. E05B 67/22; E05B 67/38; E05B 2047/0014; E05B 2047/0015; E05B 2047/0016; E05B 2047/0024; E05B 2047/0025; E05B 2047/0037; E05B 2047/0067; E05B 2047/0094; E05B 2047/0095; E05Y 2201/434; E05Y 2201/484; E05Y 2400/612; E05Y 2400/85
See application file for complete search history.

(56) References Cited

U.S. PATENT DOCUMENTS

| | | | | |
|---|---|---|---|---|
| 8,806,907 | B2 * | 8/2014 | Kalous | E05B 67/22 70/278.1 |
| 9,109,379 | B1 * | 8/2015 | Ranchod | E05B 67/00 |
| 9,495,820 | B1 * | 11/2016 | Li | E05B 67/00 |
| 9,556,651 | B1 * | 1/2017 | Cabral Herrera | E05B 67/22 |
| 10,267,062 | B2 * | 4/2019 | Lai | E05B 67/24 |
| 11,028,618 | B1 * | 6/2021 | Liu | E05B 67/22 |
| 11,105,123 | B1 * | 8/2021 | Ruffkess | E05B 67/22 |
| 2013/0086956 | A1 * | 4/2013 | Nave | E05B 67/22 70/20 |
| 2015/0292244 | A1 * | 10/2015 | Beatty | E05B 67/22 70/20 |

* cited by examiner

ELECTRONIC LOCK AND LIGHT COLOUR CONTROL METHOD FOR SAME

FIELD OF THE INVENTION

This invention relates to a lock, in particular an electronic lock, and to a method for controlling light colour of the electronic lock.

BACKGROUND OF THE INVENTION

With the continuous introduction of high technology into traditional locks, the security function of a lock has been sufficiently extended and enhanced, and the electronic lock has become an indispensable part of a classified security system and cannot be replaced with any mechanical lock in terms of importance and function. Due to its huge market potential, many local and international companies have been dedicating substantial manpower and resources for developing and manufacturing electronic locks.

An electronic lock mainly comprises a lock body, a lock hook, shifting beads, a lock shifter, a motor, etc., and uses the operation of the motor to cause the lock shifter to rotate so as to leave space for the shifting beads to retreat, such that when the lock hook is pulled upwards, the shifting beads can move inward to pull up the lock hook to unlock the electronic lock. However, in the case of the current electronic lock, resistance in transmission the motor receives while operating causes energy loss of the motor, increasing demand for power supply and for the voltage and power of the motor and shortening the service life of the electronic lock.

SUMMARY OF THE INVENTION

An object of this invention is to provide an electronic lock to solve the issue of energy loss of the motor caused by resistance in transmission the motor receives while rotating.

To solve the above issue, according to an aspect of this invention, an electronic lock is provided comprising a lock body, a lock hook, at least two shifting beads, a lock shifter, a motor and a motor actuator, wherein the shifting beads, the lock shifter, the motor and the motor actuator are mounted in the lock body, the motor actuator is mounted on the motor and interlinked with the lock shifter, the lock hook is mounted on the lock body and is able to move relative to the lock body, the shifting beads cooperate with the lock hook such that the electronic lock is tranformable between a locked state and an unlocked state, and wherein the electronic lock further comprises an elastic member which is mounted in the lock body and exerts an acting force on the shifting beads in opposite directions towards the lock hook so that the shifting beads do not exert any acting force on the lock shifter during a progress of unlocking and locking.

In an embodiment, the lock shifter comprises a first portion and a second portion, the first portion cooperating with the motor actuator, the second portion having opposite locking faces and opposite unlocking faces, wherein the shifting beads constrain the lock hook to enable the electronic lock in the locked state when the lock shifter is driven to rotate by the motor such that the locking faces mate with the shifting beads, and the shifting beads are able to move towards the unlocking faces and disengage from the lock hook to enable pull-up of the lock hook to unlock the electronic lock when the lock shifter is driven to rotate by the motor such that the unlocking faces mate with the shifting beads.

In an embodiment, the second portion of the lock shifter has a widthwise size and a lengthwise size greater than the widthwise size, and the second portion further has at two ends thereof in a lengthwise direction end faces configured as the locking faces, and front and rear faces in a widthwise direction configured as the unlocking faces.

In an embodiment, the electronic lock comprises two shifting beads which are arranged on two opposite sides of the lock shifter, and the shifting beads are substantially at the same level as the second portion of the lock shifter.

In an embodiment, the motor actuator is provided with a motor actuator chamfer and a motor actuator transmission shaft, and the first portion of the lock shifter is provided with a lock shifter transmission element which mates with the motor actuator chamfer and the motor actuator transmission shaft so that movement of the motor is transmitted to the lock shifter through the motor actuator when the motor operates.

In an embodiment, the elastic member is a torsion spring, the lock body is provided with a torsion spring mounting part, each of the shifting beads is formed as a cylinder in shape and is provided with a circumferential groove in the middle of the cylinder, a middle part of the torsion spring is fixed on the torsion spring mounting part, and two end parts of the torsion spring are respectively mounted in the grooves of the shifting beads arranged on two sides of the torsion spring.

In an embodiment, the electronic lock further comprises a printed circuit board (PCB) mounted inside the lock body and electrically connected to the motor so as to control the motor to operate, wherein a travel switch for controlling rotation of the motor is provided on the PCB, and a trigger cooperating with the travel switch is provided at an end part of the lock hook, the trigger being able to trigger the travel switch when the lock hook moves downwards in place.

In an embodiment, the lock hook is substantially U-shaped with one side of the U-shape relatively longer, two end parts of the lock hook each being provided with a limiting groove in cooperation with one of the shifting beads during to hold the lock hook in a locked position, wherein the trigger is arranged at the end part of the longer side.

In an embodiment, the end part of the longer side of the lock hook is further provided with a latching groove arranged below the limiting groove, the latching groove matching the shifting bead when the lock hook moves upwards in place, thereby preventing the lock hook from being removed from the lock body.

In an embodiment, the lock body is provided with a motor mounting part, a motor actuator mounting part, a lock shifter mounting part, two shifting bead mounting parts and a torsion spring mounting part, wherein the motor mounting part is positioned in a middle lower part of the lock body, the motor actuator mounting part is positioned above the motor mounting part, the lock shifter mounting part is adjacent to the motor actuator mounting block, the two shifting bead mounting parts are disposed at substantially the same level on two sides of the lock shifter mounting part, and the torsion spring mounting part is positioned above the lock shifter mounting part In an embodiment, the lock body is provided with a plurality of password keys and a confirmation key with a light indicator, and wherein the electronic lock is configured to be unlocked by a mobile phone application or by pressing the keys.

In an embodiment, the electronic lock is unlocked by pressing the keys in the following sequence:

Step 1: pressing the confirmation key; Step 2: pressing the password keys; Step 3:

pulling up the lock hook to unlock; Step 4: pressing down the lock hook to lock.

In an embodiment, in Step 1, pressing the confirmation key causes to activate electronic elements of the electronic lock, and the password keys are deactivated after a predetermined period of time if Step 2 is not executed; in Step 2, the password keys are pressed in sequence, followed by pressing the confirmation key, the motor starts to operate to unlock the electronic lock if a password input is correct; then Step 3 is executed, otherwise the motor automatically locks the electronic lock after a predetermined period of time if Step 3 is not executed, wherein if the password input is incorrect, the confirmation key is required to be re-pressed, followed by pressing the password keys in sequence; if incorrect passwords are input consecutively for a preset number of times, the password keys are deactivated for a predetermined period of time.

In an embodiment, in Step 3, the electronic lock is unlocked after the lock hook is pulled up, and in Step 4, the motor automatically operates to lock the electronic lock after the lock hook is pressed down.

In an embodiment, the electronic lock is unlocked by the mobile phone application in the following sequence:

Step 1: opening the mobile phone application;

Step 2: pressing the confirmation key to activate electronic elements of the electronic lock, the electronic lock is operatively coupled with the mobile phone for a certain period of time if the mobile phone and the electronic lock are within communication range;

Step 3: after the operative coupling, the motor automatically operates to drive the electronic lock in a ready-for-unlocking state; or a tap at the unlock icon on the mobile phone application drives the electronic lock in the ready-for-unlocking state;

Step 4: pulling up the lock hook to unlock; the motor automatically locks the electronic lock after a predetermined period of time if the lock hook is not pulled up;

Step 5: pressing down the lock hook, and the motor automatically locks the electronic lock;

Step 6: the electronic elements of the electronic lock automatically enter an idle state after a predetermined period of time if the mobile phone application is closed, or Bluetooth is turned off, or the mobile phone and the electronic lock are not within the communication range.

According to another aspect of this invention, a method for controlling light colour of the electronic lock according to claim 1 useful to indicate present status of the electronic lock to a user is provided, wherein the confirmation key is configured to emit blue, green or red light, wherein the blue light is on continuously, indicating that the electronic lock is locked;

the blue light is flashing quickly, indicating that the electronic lock is waiting to be operatively coupled with a mobile phone or for a password to be pressed, or that the operative coupling is in progress;

the green light is on continuously, indicating that the electronic lock is in unlocking state but the lock hook is not pulled up;

the red light is on continuously, indicating that the electronic lock is unlocked with pull-up of the lock hook, or that excessive misoperation results in failure to unlock the electronic lock;

the red light is flashing quickly, indicating that a password input is wrong;

the red light is flashing slowly, indicating that battery level is low and battery replacement is required.

According to another aspect of the present invention, an electronic lock comprising a lock body, a lock hook, at least two shifting beads, a lock shifter, a motor and a motor actuator is provided, wherein the shifting beads, the lock shifter, the motor and the motor actuator are mounted in the lock body, the motor actuator is mounted on the motor and interlinked with the lock shifter, the lock hook is mounted on the lock body and is able to move relative to the lock body, the shifting beads cooperate with the lock hook such that the electronic lock is transformable between a locked state and an unlocked state, wherein the lock shifter comprises a first portion and a second portion, the first portion cooperating with the motor actuator, the second portion having opposite locking faces and an opposite unlocking faces, wherein the shifting beads constrain the lock hook to enable the electronic lock in the locked state when the lock shifter is driven to rotate by the motor such that the locking faces mate with the shifting beads, and the shifting beads are able to move towards the unlocking faces and disengage from the lock hook to enable pull-up of the lock hook to unlock the electronic lock when the lock shifter is driven to rotate by the motor such that the unlocking faces mate with the shifting beads.

In an embodiment, the second portion of the lock shifter is a prism in shape, and has a widthwise size and a lengthwise size greater than the widthwise size, and the second portion further has at two ends thereof in a lengthwise direction end faces configured as the locking faces, and front and rear faces in a widthwise direction configured as the unlocking faces.

In an embodiment, the electronic lock comprises two shifting beads which are arranged on two opposite sides of the lock shifter, and the shifting beads are substantially as the same level at the second portion of the lock shifter.

In an embodiment, the electronic lock further comprises a PCB mounted inside the lock body and electrically connected to the motor so as to control the motor to operate, wherein a travel switch for controlling rotation of the motor is provided on the PCB, and a trigger cooperating with the travel switch is provided at an end part of the lock hook, the trigger being able to trigger the travel switch when the lock hook moves downwards in place.

The electronic lock of this invention does not exert an acting force on the shifting bead during unlocking and locking and the motor has no loading, thus the demand for power supply and the voltage and power of the motor and decreases, energy consumption is reduced and the service life of the electronic lock is extended.

BRIEF DESCRIPTION OF THE DRAWINGS

FIGS. 9A and 9B show perspective views of the PCB, in which FIG. 9A shows a front side of the PCB and FIG. B the reverse side of the PCB.

DETAILED DESCRIPTION OF THE INVENTION

For ease of understanding of the object, features and advantages of this invention, the preferred embodiments of this invention will be more comprehensively described below in conjunction with the appended drawings. It should be understood that the embodiments shown in the appended drawings do not serve as a limitation to the scope of this invention but as an explanation of the substantial concept of the technical solution of this invention.

Figure 1:
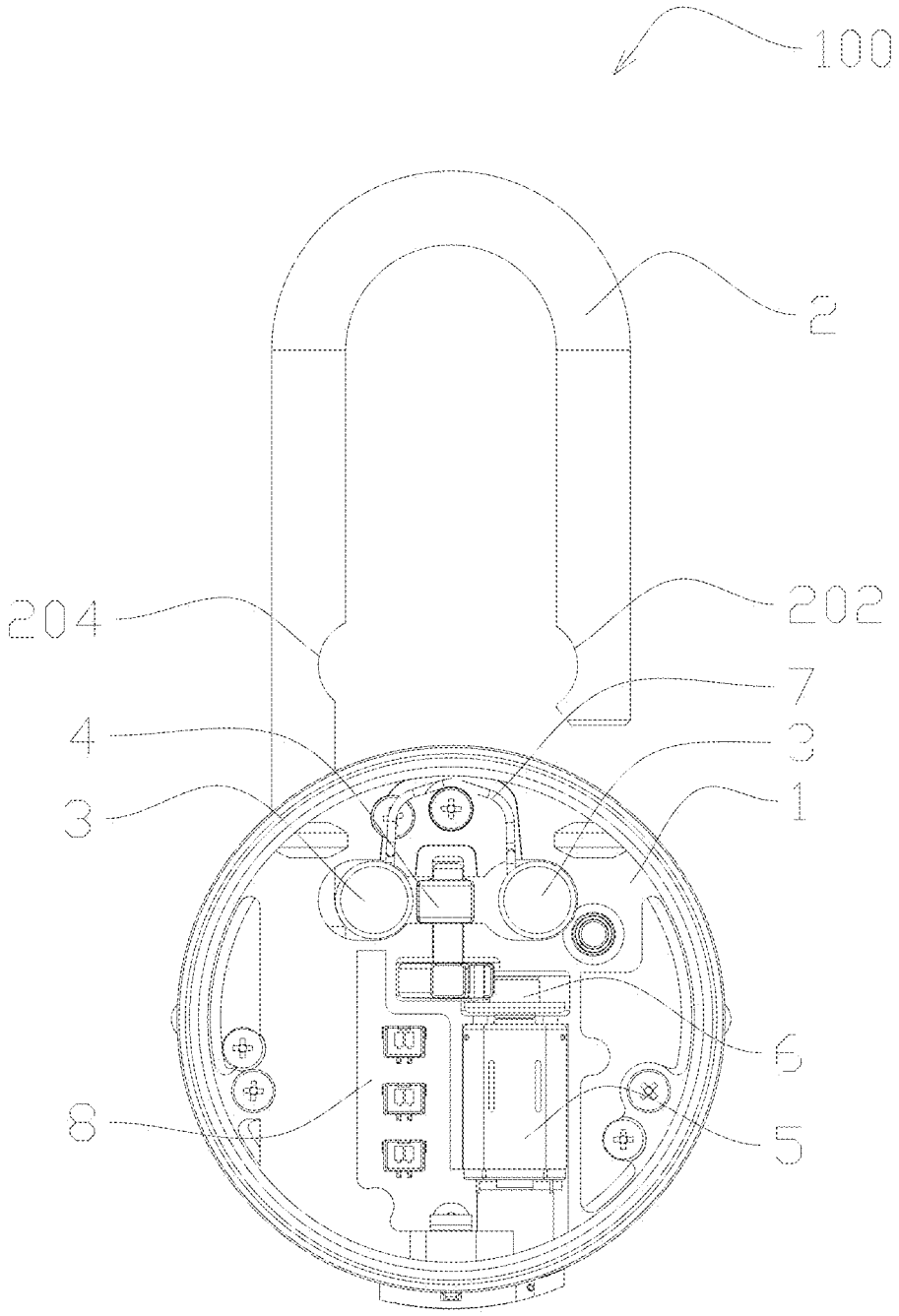
FIGS. 1 and 2 show main views of the electronic lock of this invention, in which the electronic lock is in the unlocked state in FIG. 1 and in the locked state in FIG. 2.
Figure 2:
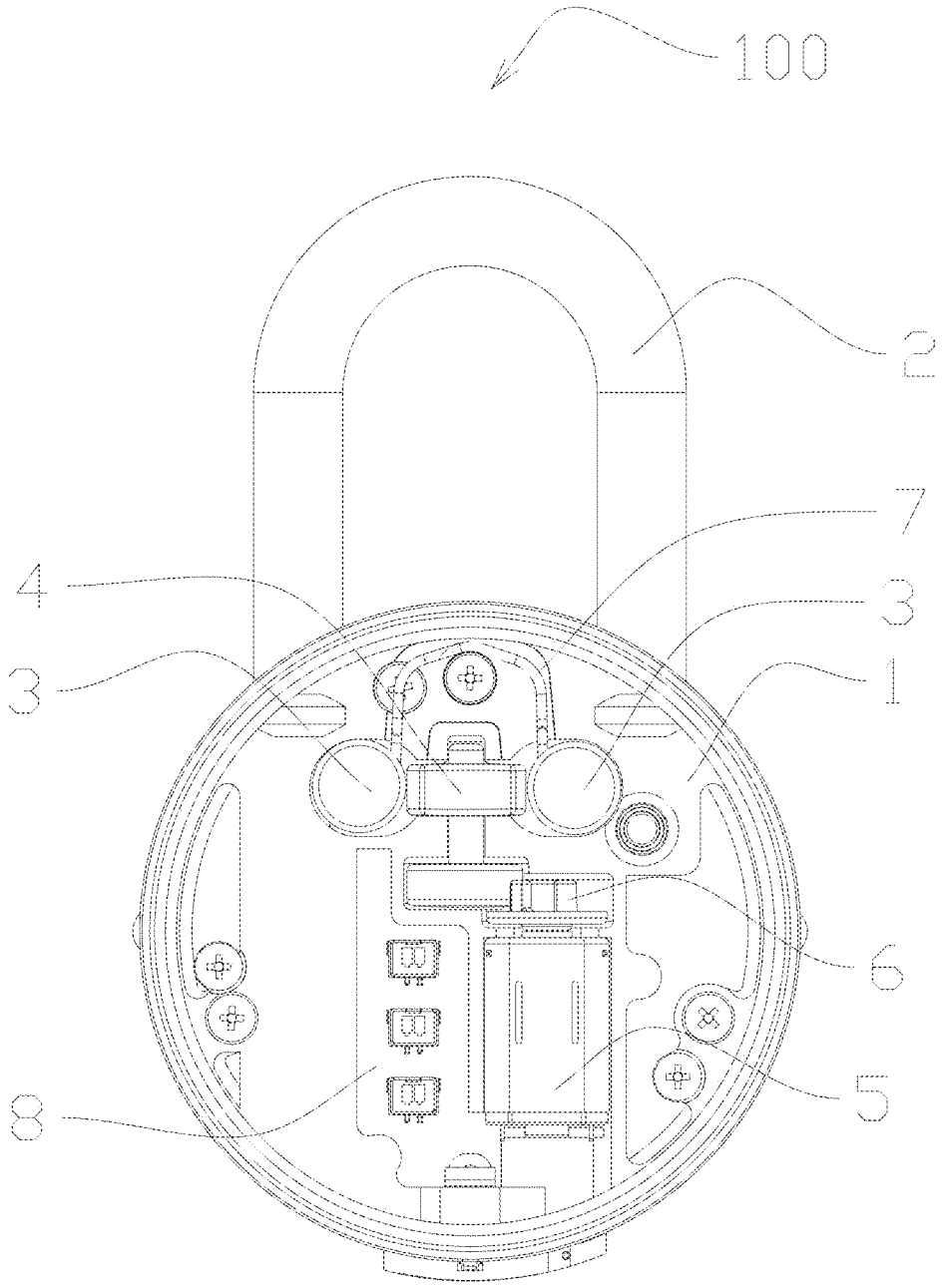

FIGS. 1 and 2 show main views of the electronic lock of this invention, in which the electronic lock is in the unlocked state in FIG. 1 and in the locked state in FIG. 2, with the upper cap and the lower cap of the lock body removed for clarity. As shown in FIGS. 1 and 2, the electronic lock 100 comprises a lock body 1, a lock hook 2, shifting beads 3, a lock shifter 4, a motor 5, a motor actuator 6, a torsion spring 7 and a printed circuit board (hereinafter called "PCB") 8. In the electronic lock 100, the lock body comprises an assembled lock main body (hereinafter called "lock body") 1, an upper lock body cap and a lock body lower cap (not shown). The shifting beads 3, the lock shifter 4, the motor 5, the motor actuator 6, the torsion spring 7 and the PCB 8 are mounted in the lock body 1, the lock hook 2 is mounted on the lock body 1 and is able to move with respect to the lock body 1, so that the electronic lock is in the locked state or the unlocked state.

Figure 3A:
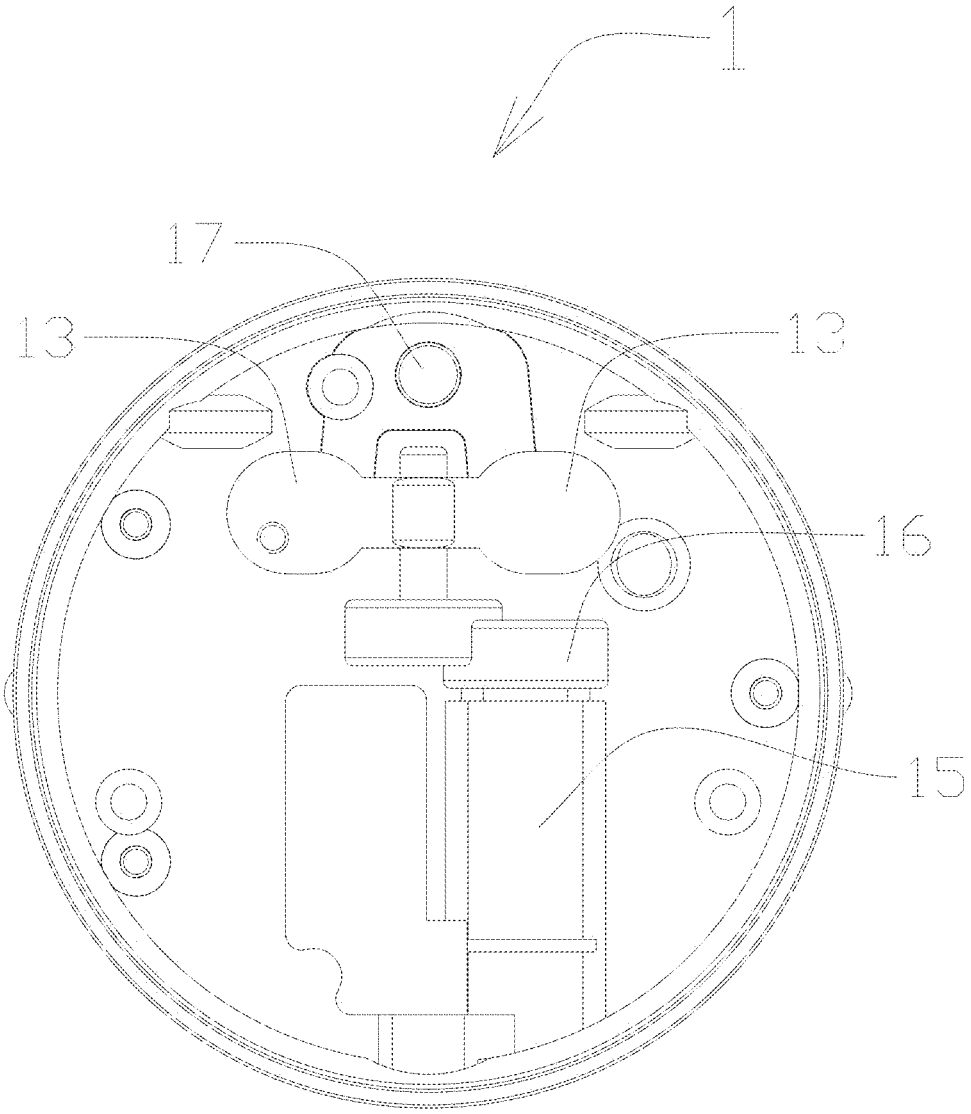
FIG. 3A shows a main view of the lock body.
Figure 3B:
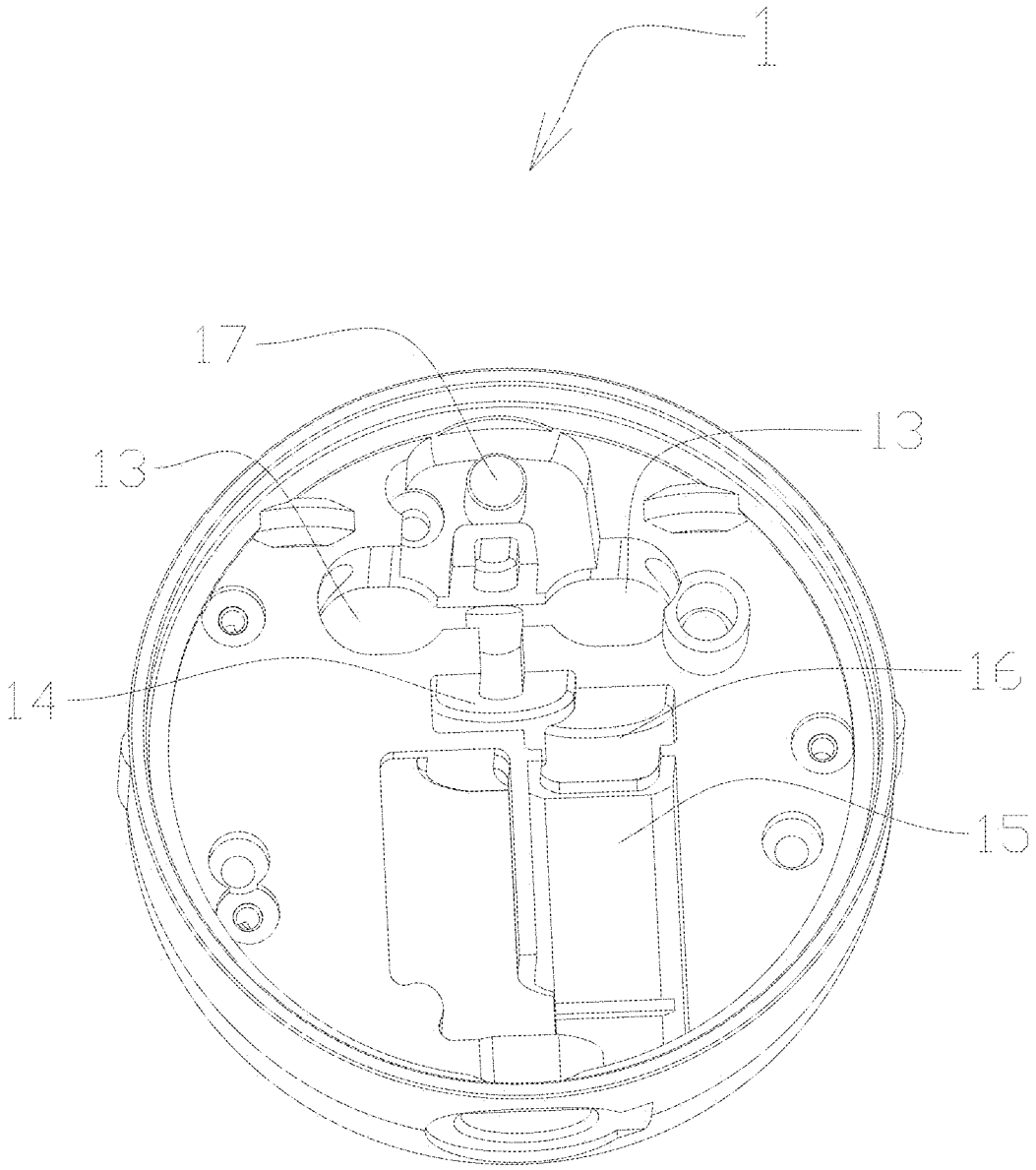
FIG. 3B shows a perspective view of the lock body.

FIG. 3A shows a main view of the lock body; FIG. 3B shows a perspective view of the lock body. As shown in FIGS. 3A and 3B, the lock body 1 is circular, the inside of the lock body 1 is provided with a motor mounting part 15, a motor actuator mounting part 16, a lock shifter mounting part 14, two shifting bead mounting parts 13 and a torsion spring mounting part 17, wherein the motor mounting part 15 is provided at the position to the right (in the figure) of a vertical axis and is located in the middle lower part of the lock body 1, the motor actuator mounting part 16 is positioned above the motor mounting part 15, the lock shifter mounting part 14 is adjacent to the motor actuator mounting part 16, the two shifting bead mounting parts 13 are disposed at substantially the same level on two sides of the lock shifter mounting part 14, and the torsion spring mounting part 17 is positioned right above the lock shifter mounting part 14.

Figure 4:
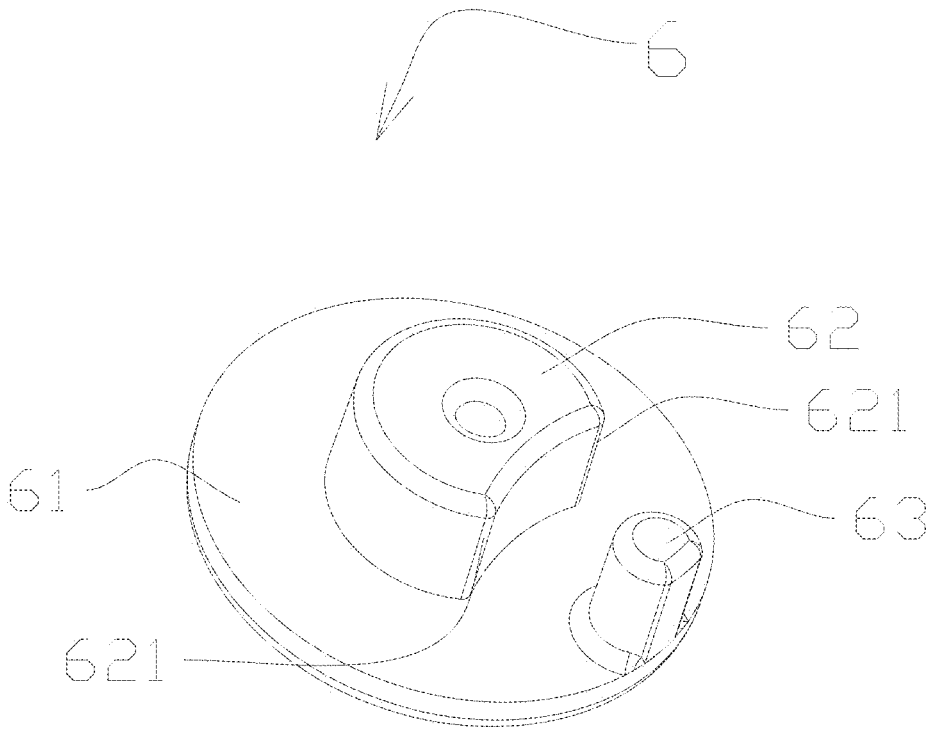
FIG. 4 shows a perspective view of the motor actuator.

FIG. 4 shows a perspective view of the motor actuator. As shown in FIG. 4, the motor actuator 6 comprises a bottom plate 61, a protrusion 62 provided on the bottom plate 61, and a motor actuator transmission shaft 63. The main body part of the protrusion 62 is formed as a cylinder in shape, a recess is provided on a side of the cylinder facing the motor actuator transmission shaft 63, and two ends of the recess form a motor actuator chamfer 621, wherein a transmission aperture 62 cooperating with the rotation shaft of the motor is provided in the protrusion 62, in which the rotation shaft of the motor is mounted so that the motor is able to drive the motor actuator 6 to rotate when operating. The motor actuator chamfer 621 and the motor actuator transmission shaft 63 mate with a lock shifter transmission element on the lock shifter 4 in order to cause the movement of the motor actuator 6 to drive the movement of lock shifter 4, details of which will be further described below.

Figure 5:
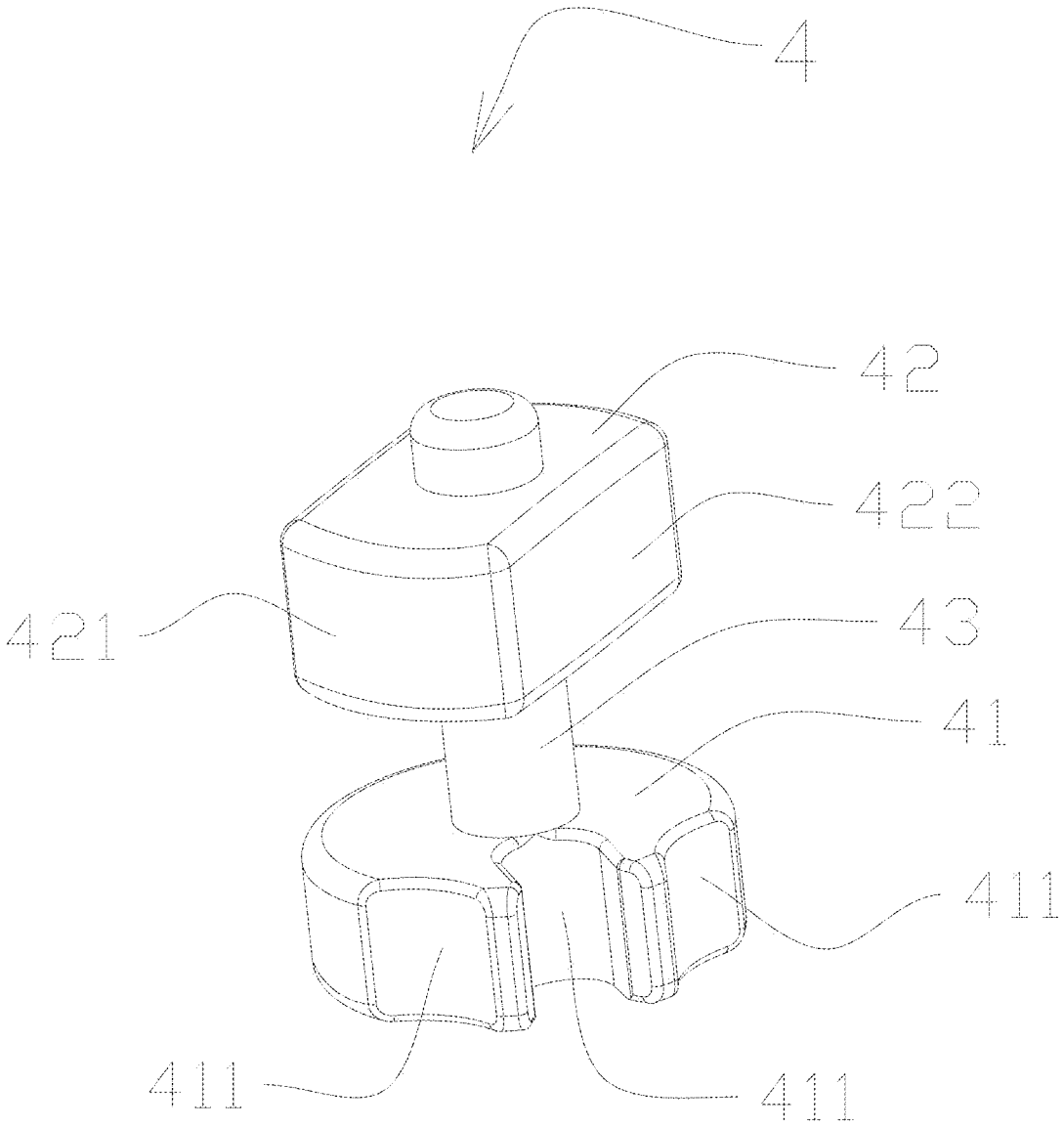
FIG. 5 shows a perspective view of the lock shifter.

FIG. 5 shows a perspective view of the lock shifter 4. As shown in FIG. 5, the lock shifter 4 comprises a first portion 41 and a second portion 42, with the first portion 41 formed as a disc in shape, the second portion formed as a prism in shape and the first portion 41 and the second portion 42 connected through a cylindrical part 43. Lock shifter transmission elements 411 are provided on the disc-shaped first portion 41. The lock shifter transmission elements 411 are the three arc notches on the disc-shaped first portion 41, which mate with the motor actuator transmission shaft 63 and the motor actuator chamfer 621 on the motor actuator 6 in order to cause the clockwise and anticlockwise movement of the motor actuator 6 to drive the horizontal and vertical movement of the lock shifter 4, details of which will be further described below.

The prism-shaped second portion 42 of the lock shifter 4 has opposite locking faces 421 and opposite unlocking faces 422, with the locking faces 421 being end faces at two ends of the prism-shaped second portion 42 in a lengthwise direction, the unlocking faces 422 being front and rear faces of the prism-shaped second portion 42 in a widthwise direction. As shown in FIG. 1, when the lock shifter 4 and the shifting beads 3 are mounted on the lock shifter mounting part 14 and the shifting bead mounting parts 13 respectively, the length of the second portion 42 of the lock shifter 4 is substantially equal to the distance between the inner sides of the shifting beads 3, that is, when the lock shifter is horizontally mounted on the lock shifter mounting part 14, two ends (i.e. the locking face 421) of the second portion 42 respectively contact the shifting beads 3 on two sides so as to prevent the shifting beads 3 on two sides from moving inward to unlock the electronic lock; whereas when the lock shifter is vertically mounted on the lock shifter mounting part 14, the front and rear faces (i.e. the unlocking face 422) of the second portion 42 respectively face the shifting beads 3 on two sides, together with the fact that the lock shifter 4 has a length longer than its width (i.e. the distance between the two locking faces 421 is larger than that between the two unlocking faces 422), space for retreating is therefore reserved in two ends of the lock shifter mounting part 14 so that when the pull-up of the lock hook 2 is exerting an inward acting force on the shifting beads 3, the shifting beads 3 can be forced to move in opposite directions, and thus the lock hook 2 can be pulled upwards to unlock the electronic lock.

Figure 6:
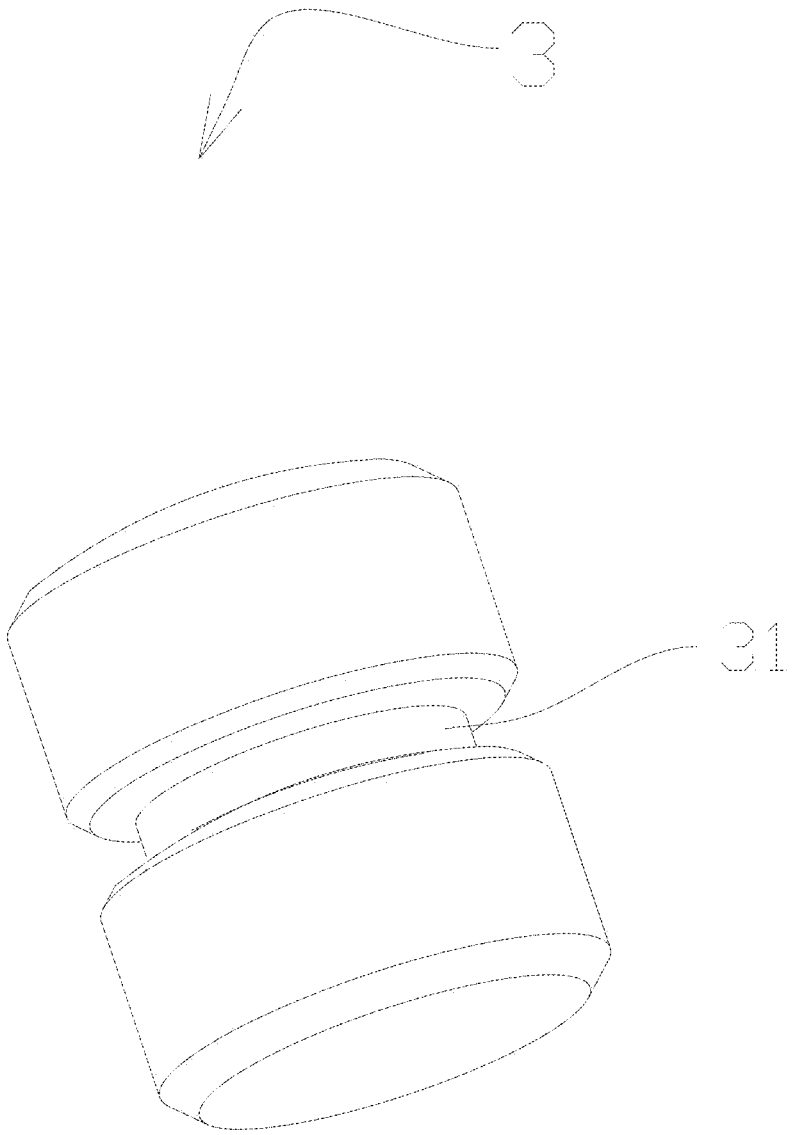
FIG. 6 shows a perspective view of the shifting bead.

FIG. 6 shows a perspective view of the shifting bead 3. As shown in FIG. 6, the shifting bead 3 is formed as a cylinder in shape and is provided with a groove 31 in the middle of the cylinder. The groove 31 is used to match the torsion spring 7, that is, the torsion spring 7 can be snapped into the groove 31.

Figure 7:
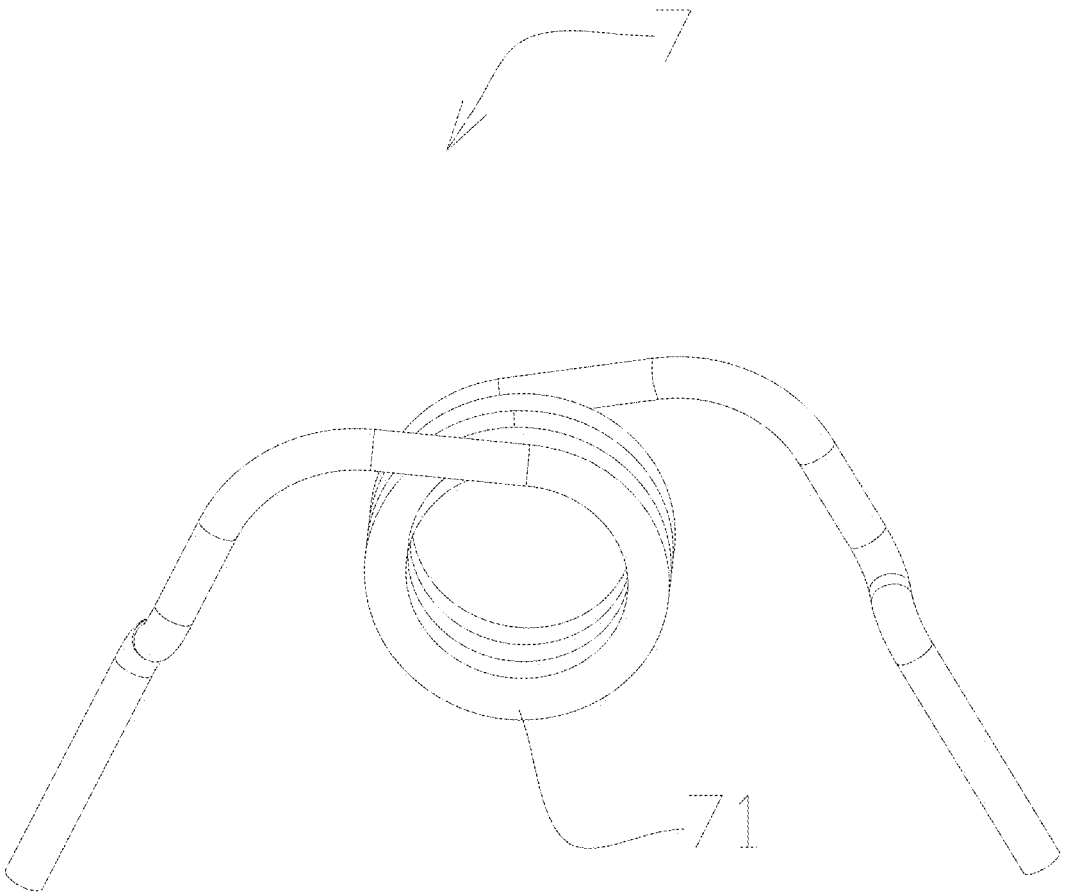
FIG. 7 shows a perspective view of the torsion spring.

FIG. 7 shows a perspective view of the torsion spring. As shown in FIG. 7, a middle part of the torsion spring 7 forms coils 71 mating with the torsion spring mounting part 17. The coils 71 are mounted on the torsion spring mounting part 17 of the lock body 1. Two ends of the torsion spring 7 are respectively housed in the groove 31 of the shifting bead 3 on each of the two sides and exert outward spring force on the shifting beads 3 on the two sides, such that the shifting beads 3 on the two sides always mate with recesses of the lock hook 2 in the locked state, details of which will be further described below.

Those skilled in the art should appreciate that, although in this embodiment a torsion spring is used to exert outward spring force on the shifting beads 3, other elastic members can also be used to achieve that function.

Figure 8A:
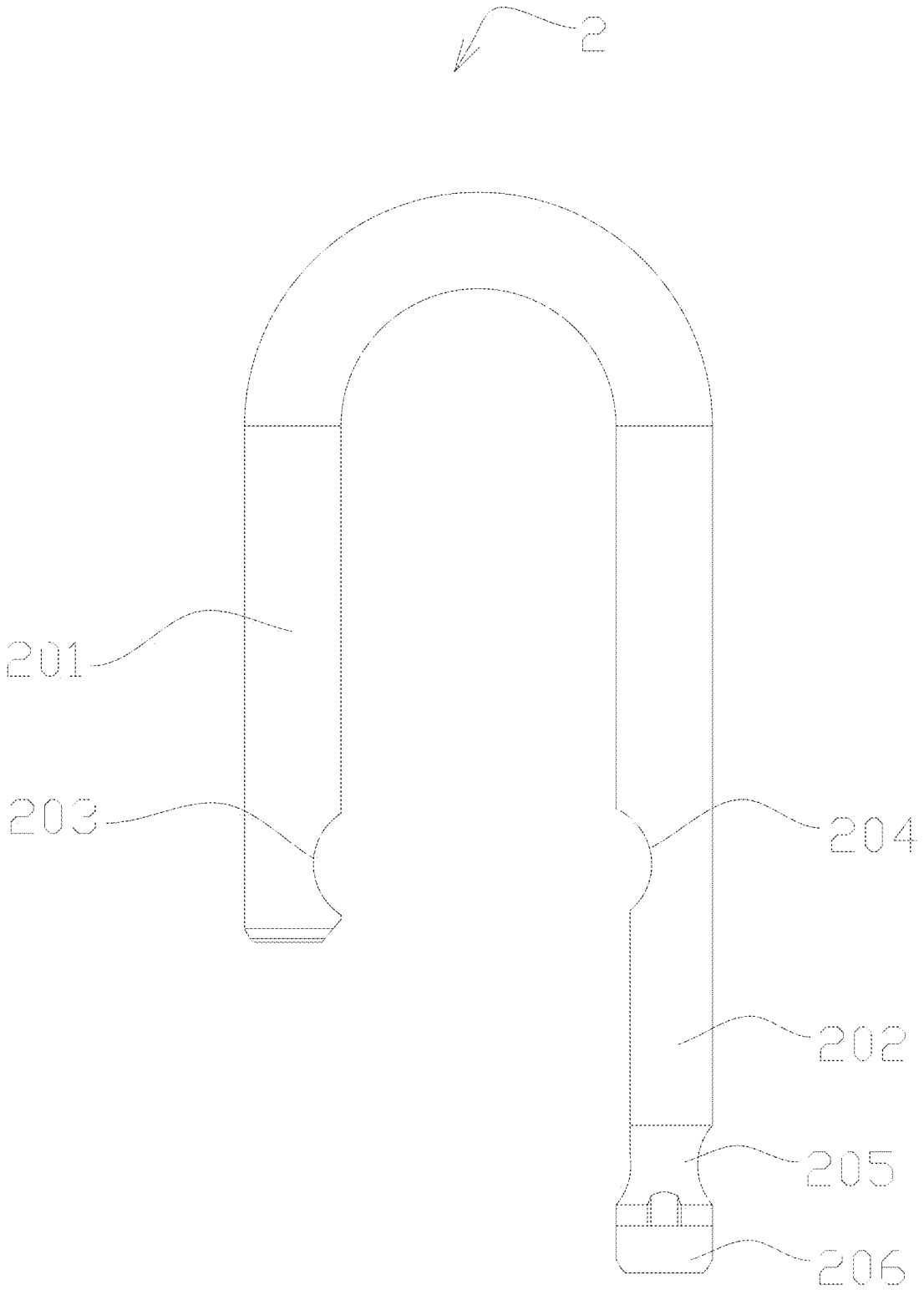
FIG. 8A shows a main view of the lock hook.
Figure 8B:
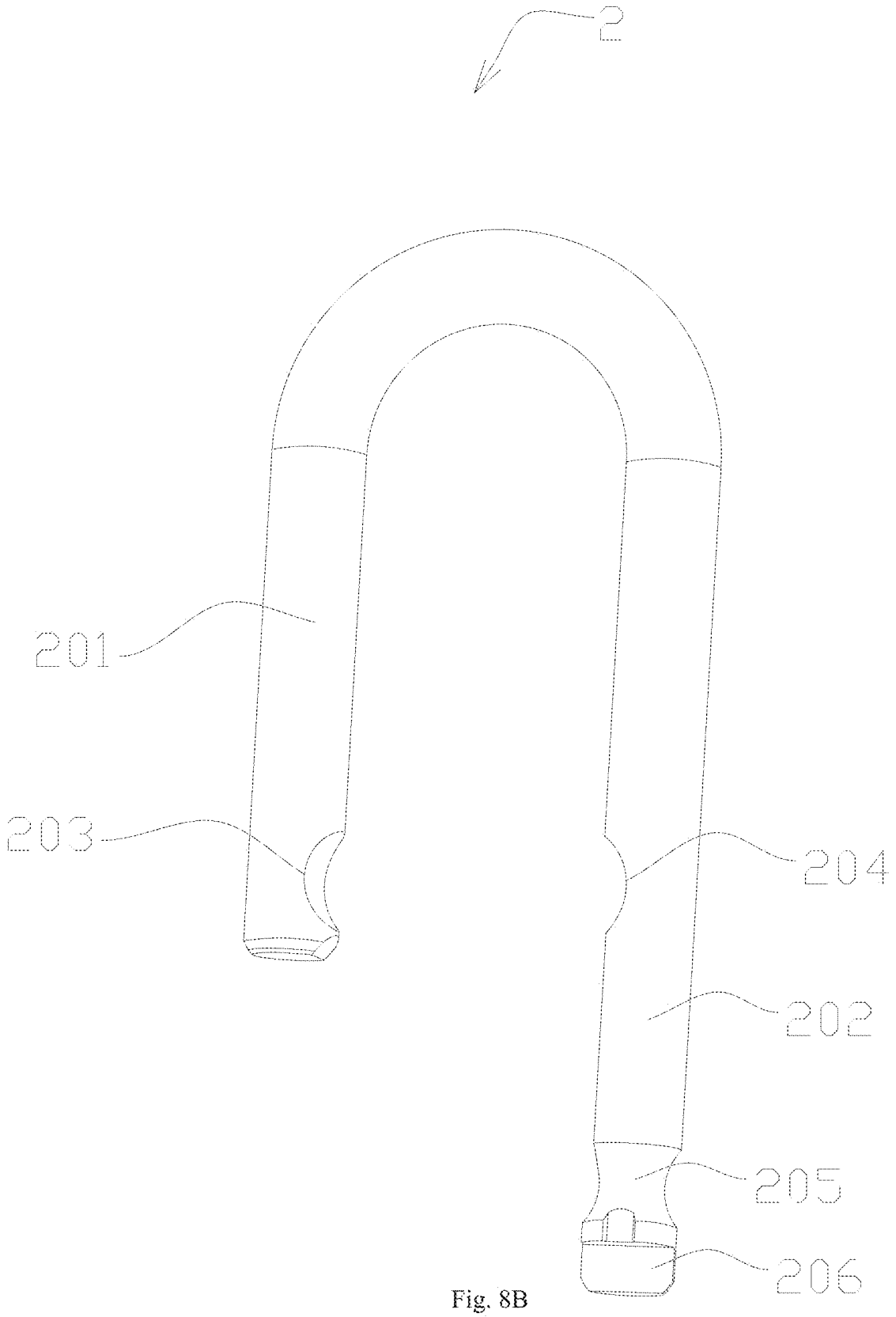
FIG. 8B shows a perspective view of the lock hook.

FIG. 8A shows a main view of the lock hook; FIG. 8B shows a perspective view of the lock hook. As shown in FIGS. 8A and 8B, in particular, the lock hook 2 is substantially U-shaped with one side of the U-shape relatively longer. One end part 201 (the end part of the shorter side of the U-shape) of the lock hook 2 is provided with a limiting groove 202 for matching the shifting bead 3 during locking so as to hold the lock hook 2 in a locked position (see FIG. 1). The other end part 203 (the end part of the longer side of the U-shape) of the lock hook 2 is provided with another limiting groove 204. The function of the limiting groove 204 is essentially the same as that of the limiting groove 202, also for cooperating with one of the shifting beads 3 housed in the lock body and subsequently cooperating with the lock shifter 4 to keep the end part 203 being locked in the lock body. A latching groove 205 is further provided on the end part 203 of the lock hook 2. When the lock hook 2 moves upwards in place to unlock the electronic lock, the latching groove 205 cooperating with the shifting bead 3, thereby preventing the lock hook 2 from being removed from the lock body 1.

Still referring to FIGS. 8A and 8B, a trigger 206 is further provided on the end part 203 of the lock hook 2 below the latching groove 206. When the lock hook 2 moves downwards in place, the trigger 206 triggers a travel switch on the PCB to trigger the rotation of the motor 5 and to drive the lock shifter 4 to rotate by driving the motor actuator 6 to rotate, such that the locking faces of the lock shifter 4 mate with the groove on the shifting beads 3 to lock the electronic lock, details of which will be further described below.

Figure 9A:
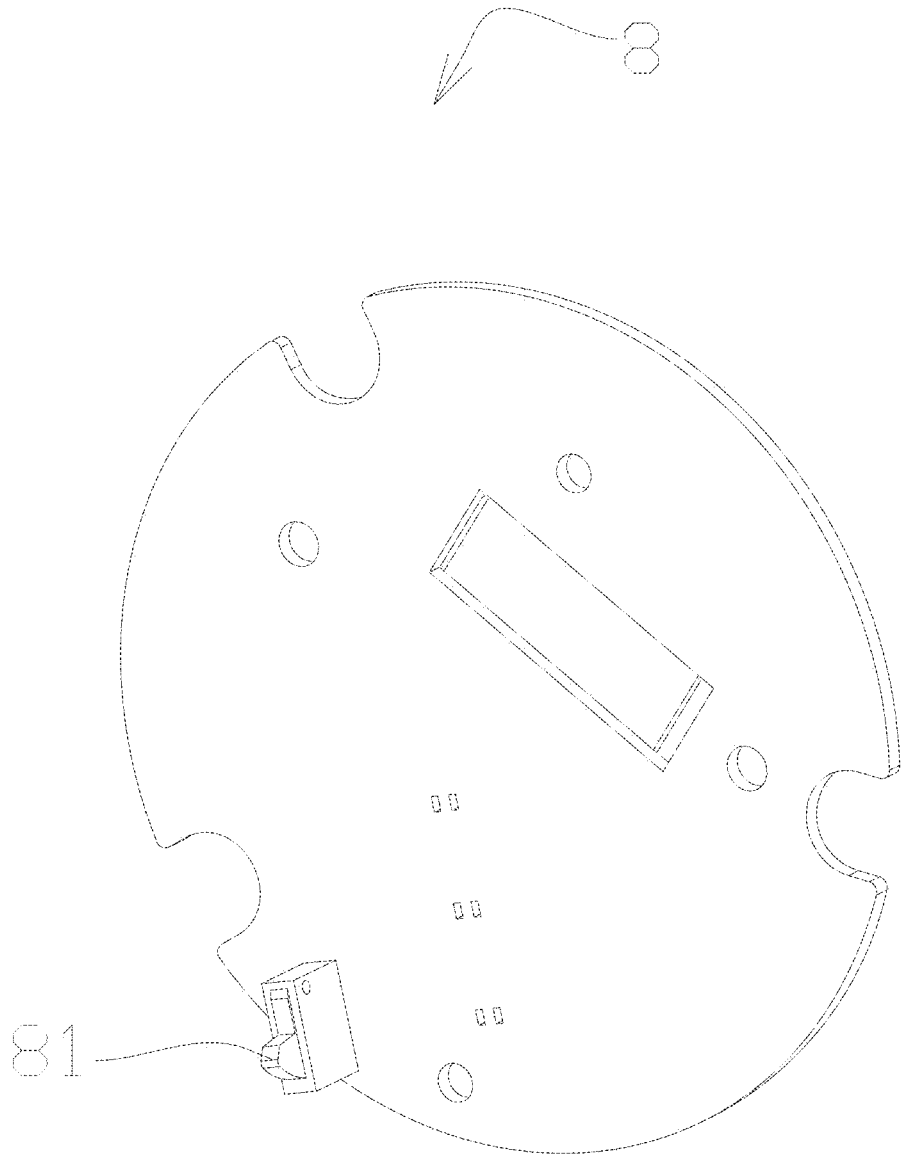
Figure 9B:
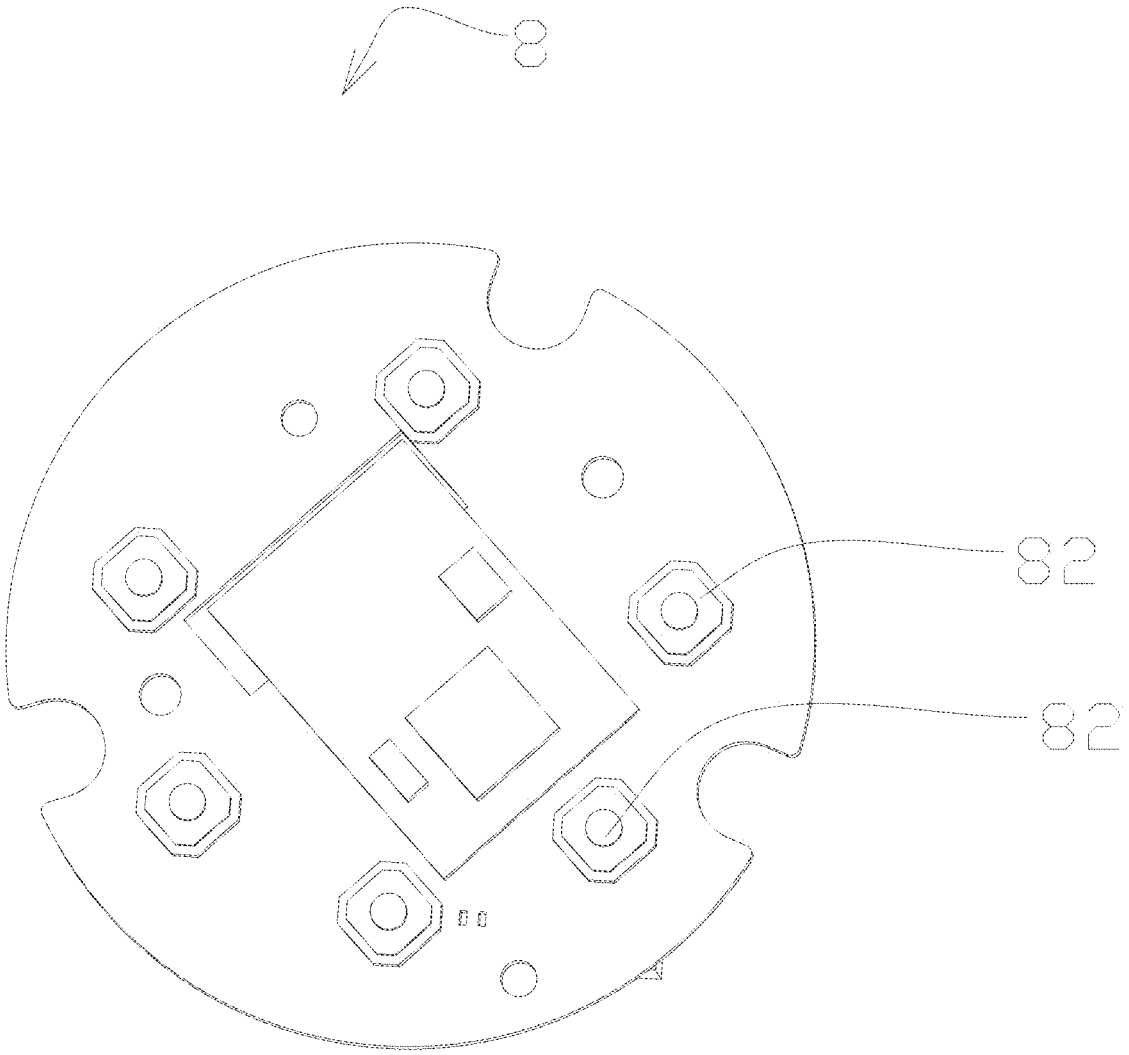

FIGS. 9A and 9B show perspective views of the PCB, in which FIG. 9A shows a front side of the PCB and FIG. B the reverse side of the PCB. As shown in FIGS. 9A and 9B, the PCB is a circular board, at a position close to the edge of which a travel switch 81 is positioned and in the middle part of which a plurality of keys 82 comprising a confirmation key, a plurality of password keys and a light indication control key are positioned in a circular pattern. The said keys can be touch keys or push keys or keys similar to the aforementioned types. When the PCB 8 is mounted on the lock body 1 with fixtures such as screws, the travel switch 81 is located beneath the lock body and is arranged such that when lock hook 2 locks the electronic lock and moves downwards in place, the trigger just triggers the travel switch 81 as shown in FIG. 11.

Referring back to FIGS. 1 and 2, as shown in FIGS. 1 and 2, the motor actuator 6 is fixedly mounted on the motor 5 and interlinked with the motor 5; the motor 5 is mounted on the motor mounting unit 51 of the lock body 1; the lock shifter is mounted at the lock shifter mounting part 14; the shifting beads 3 are mounted at two shifting bead mounting units 13 and located on each of the two sides of the lock shifter 4; the torsion spring 7 is mounted at the torsion spring mounting part 17, wherein specifically the coils 71 are mounted on the torsion spring mounting part 71, and each of the two ends of the torsion spring 7 is introduced in the groove 31 in the middle of the shifting bead 3 and keeps exerting an acting force on the shifting bead 3 on each of the two sides. The lock hook 2 is mounted on the lock body and the longer end 203 of the lock hook 2 is mounted at a first lock hook mounting part 121. The PCB 8 is mounted on the lock body 1 and is fixed together with the lock body 1 with fixtures such as screws. The PCB 8 is electrically connected to the motor 5 so that the movement of the motor, including clockwise rotation, anticlockwise rotation, stop, etc., can be controlled through the PCB.

Figure 10:
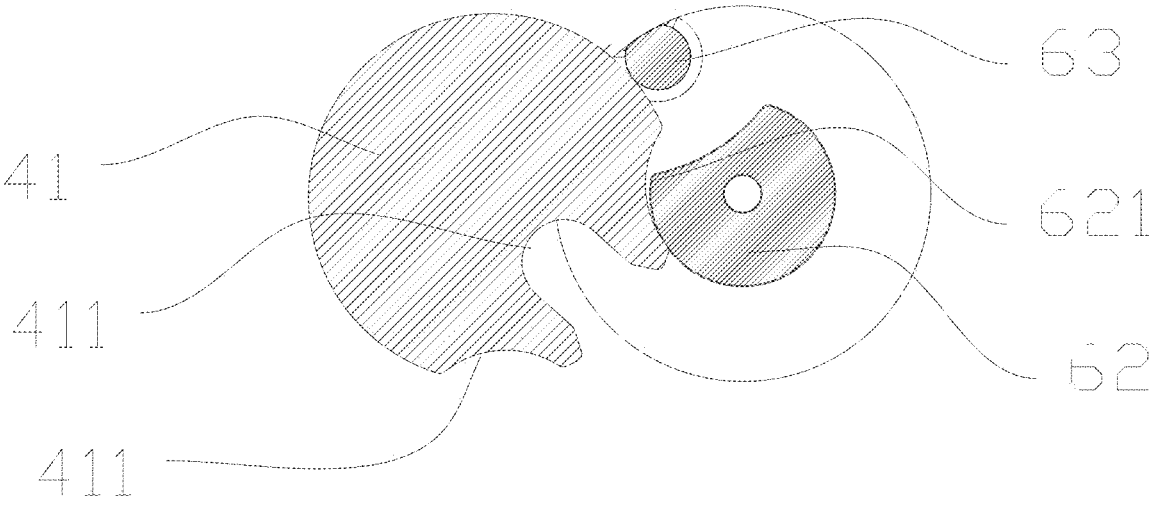
FIG. 10 shows the mutually cooperative relation between the lock shifter and the motor actuator.

FIG. 10 shows the mutually cooperative relation between the lock shifter 4 and the motor actuator 6. As shown in FIG. 10, when the motor 5 operates clockwise or anticlockwise under the control of the PCB 8, the motor actuator 6 also rotates clockwise or anticlockwise respectively. At the same time, since the motor actuator transmission shaft 63 and the motor actuator chamfer 621 cooperate with the arrival of the lock shifter 4 at the lock shifter transmission element, the horizontal and vertical control of the lock shifter 4 can be achieved, that is, the rotation of the lock shifter 4 can make the locking faces 421 or the unlocking faces 422 of the lock shifter 4 face the shifting bead 3, thereby enabling unlocking or locking the electronic lock respectively. In particular, the clockwise and anticlockwise rotation of the motor is controlled through the PCB. When the lock hook 2 is pressed down in place, the trigger 206 on the lock hook 2 triggers the travel switch of the PCB so that the electronic lock can be unlocked through the motor controlled by the PCB.

Figure 11:
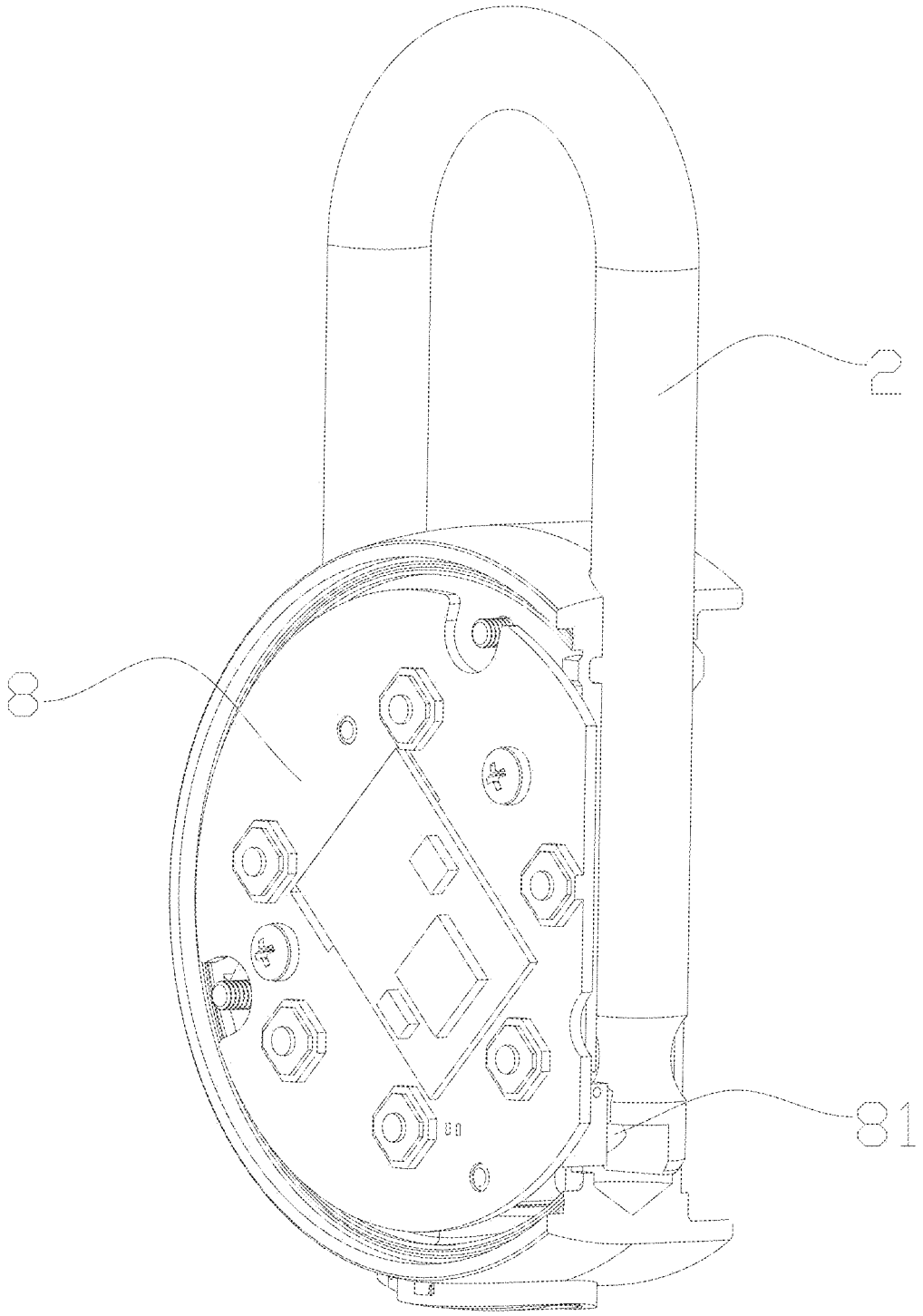
FIG. 11 shows a perspective section view of the electronic lock with all parts (except the front cap and the rear cap) mounted in place.

FIG. 11 shows a perspective section view of the electronic lock 100 with all parts (except the front cap and the rear cap) mounted in place, wherein the electronic lock 100 is in the locked state. As shown in FIG. 11, the PCB is fixed on the lock body 1 with fixtures such as screws. It is clearly visible that the trigger 206 of the lock hook 2 abuts against the travel switch 81 of the PCB board.

The sequences of unlocking and locking the electronic lock of this invention are explained below in conjunction with FIGS. 1 and 2. During locking, the torsion spring 7 keeps exerting an acting force on the shifting beads on two sides to keep them under the effect of the outward force moving towards the two sides. Therefore, the shifting beads 3 do not exert an acting force on the lock shifter. While during unlocking, the motor actuator 5 drives the lock shifter to rotate first to make the horizontal lock shifter 4 become vertical, that is, to make the unlocking faces 422 of the lock shifter 4 face the shifting beads 3. At that time, the lock hook 2 can be pulled up to unlock the electronic lock. Due to the action of the torsion spring 7, the shifting beads of the two sides keep staying at the positions farthest from the center so as to not add extra load to the motor 5. To lock the electronic lock again, the lock hook 2 should be pressed down first. When the lock hook 2 is pressed down in place, the trigger 206 on the lock hook 2 triggers the travel switch 81 of the PCB to control the anticlockwise rotation of the motor 5, and the shifting beads 3 on the two sides return to their original places under the effect of the torsion spring 7, during which the lock shifter 4 is driven by the motor actuator 6 to rotate anticlockwise and does not contact the shifting beads 3 on the two sides.

In summary, the electronic lock of this invention makes the motor operate without loading during locking and unlocking, and thus can reduce energy loss of the motor caused by resistance in transmission the motor receives while rotating, thereby lowering demand for power supply and for the voltage and power of the motor and prolonging the service life of the electronic lock.

Two methods of controlling the electronic lock 100 of this invention are described below: operatively coupling the electronic lock 100 to a mobile phone through Bluetooth and then controlling the electronic lock 100 through a mobile phone application; and controlling the electronic lock 100 with keys provided on the lock body 1.

Figure 12:
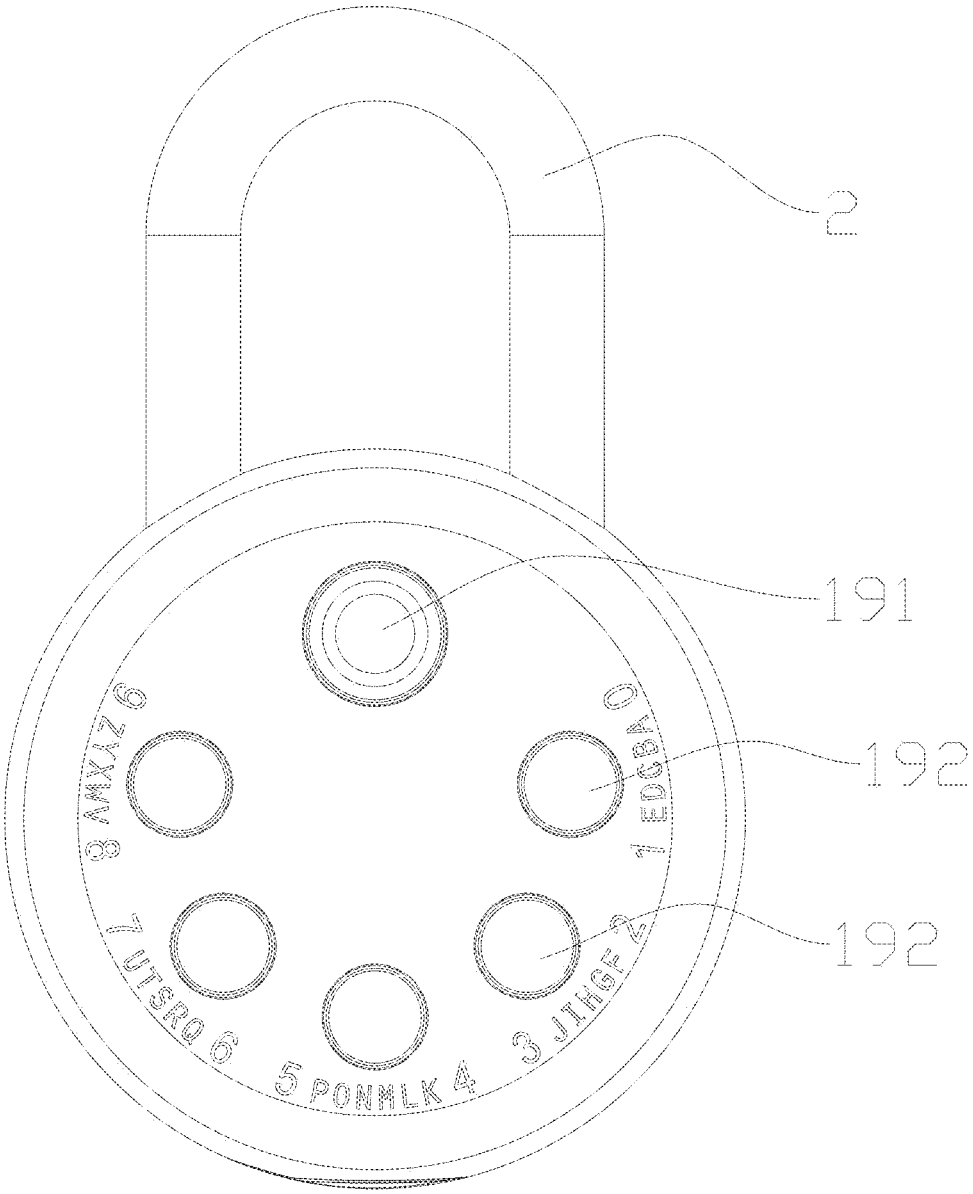
FIG. 12 shows a perspective view of the outlook of the electronic lock.

FIG. 12 shows a perspective view of the outlook of the electronic lock. As shown in FIG. 12, a confirmation key 191 and other keys 192 are provided on the lock body 1, wherein the confirmation key 191 has a circular indicator lamp 1911, which can display different colours to indicate different status.

Lock and unlock the electronic lock 100 through keys by executing the following method:

Step 1: Press the confirmation key 191, then the indicator lamp 1911 flashes quickly in blue. If no password key is pressed, the password keys are deactivated after the indicator lamp has been flashing in blue quickly for a predetermined period of time (e.g. 15 seconds).

Step 2: Press the password keys in sequence. When the first password key is pressed, the indicator lamp stops flashing in blue and flashes in green once, and then flashes in green once again whenever a password key is pressed (wherein a password key controls corresponding alphabets and numbers, such as the password key 192 at the rightmost of FIG. 11 corresponding to numbers and alphabets 0ABCDE1). Press the confirmation key after pressing the password keys; wherein, the indicator lamp keeps lighting in green if a password input is correct, then the lock hook can be pulled up to unlock the electronic lock; if the lock hook is not pulled up, the electronic lock is automatically locked after a predetermined period of time (e.g. 30 seconds);

the indicator lamp flashes quickly in red if a password input is incorrect; press the confirmation key, then the indicator lamp flashes quickly in blue; then press the password keys in sequence again;

if incorrect passwords are input consecutively for a preset number of times (e.g. 3 times), the confirmation key keeps lighting in red for a certain period of time (e.g. 30 seconds), i.e. the password keys are deactivated for a predetermined period of time (e.g. 30 seconds).

Step 3: Pull up the lock hook, then the indicator lamp keeps lighting in red.

Step 4: Press down the lock hook in place (i.e. the trigger of the lock hook contacts the travel switch of the PCB), then the indicator lamp changes from red to blue and keeps lighting in blue (the indicator lamp keeps lighting in red if the lock hook is not in place). The indicator lamp of the confirmation key goes off after a predetermined period of time.

Lock and unlock the electronic lock 100 with a mobile phone application by executing the following method:

Step 1: Start the mobile phone application having a function of automatic reminding to enable Bluetooth on the mobile phone.

Step 2: Press the confirmation key, then the indicator lamp flashes quickly in blue. When the mobile phone and the electronic lock are within communication range (e.g. within 3 m), the electronic lock is automatically operatively coupled with the mobile phone within a predetermined period of time (e.g. within 10 seconds). The confirmation key flashes quickly in blue during operative coupling and then keeps lighting in blue after the operative coupling is complete.

Step 3: Press the unlock key in the mobile phone application. The confirmation key lights in green, then the lock hook can be pulled up to unlock the electronic lock. If the lock hook is not pulled up, the electronic lock is automatically locked after a predetermined period of time (e.g. 30 seconds).

Step 4: Pull up the lock hook, then the indicator lamp keeps lighting in red.

Step 5: Press down the lock hook in place (i.e. the trigger of the lock hook contacts the travel switch of the PCB), then the indicator lamp changes from red to blue and keep lighting in blue (the indicator lamp keeps lighting in red if the lock hook is not in place); the indicator lamp of the confirmation key goes off after a predetermined period of time.

Step 6: Close the mobile phone application or disable Bluetooth. The indicator lamp of the confirmation key goes off after a predetermined period of time.

The light colour control of the electronic lock 100 of this invention generally uses the following pattern:

| Light colour | Keep lighting | Flashing quickly | Flashing slowly |
|---|---|---|---|
| Blue | During locking; after operatively coupled with the mobile phone | Waiting to be operatively coupled with the mobile phone; waiting for password; operative coupling in progress | |
| Green | Unlocked but lock hook not pulled up | | |
| Red | Unlocked and lock hook pulled up; operation suspended due to excessive misoperation | Incorrect password | Low battery level signal |

The electronic lock of this invention is able to make shifter beads not exert any acting force on a lock shifter and a motor operate without loading during unlocking and locking of the electronic lock, thereby lowering demand for power supply and for the voltage and power of the motor, reducing energy loss and prolonging the service life of the electronic lock.

The preferred embodiments of this invention have been described above. However, it should be understood that, after reading the above teachings of this invention discussed above, those skilled in the art can make various changes or modifications to this invention. These equivalent forms also fall within the scope of the appended claims of the present application.

What is claimed is:

1. An electronic lock comprising a lock body, a lock hook, at least two shifting beads, a lock shifter, a motor and a motor actuator, wherein the shifting beads, the lock shifter, the motor and the motor actuator are mounted in the lock body, and the motor actuator is mounted on the motor and interlinked with the lock shifter, the lock hook is mounted on the lock body and is able to move with respect to the lock body, the shifting beads cooperate with the lock hook such that the electronic lock is transformable between a locked state and an unlocked state, and wherein the electronic lock further comprises an elastic member which is mounted in the lock body and exerts an acting force on the shifting beads in opposite directions towards the lock hook so that the shifting beads do not exert any acting force on the lock shifter during a progress of unlocking and locking, wherein the elastic member is a torsion spring, the lock body is provided with a torsion spring mounting part, each of the shifting beads is formed as a cylinder in shape and is provided with a circumferential groove in the middle of the cylinder, and wherein a middle part of the torsion spring is fixed on the torsion spring mounting part, and two end parts of the torsion spring are respectively mounted in the grooves of the shifting beads arranged on two sides of the torsion spring.

2. The electronic lock of claim 1, wherein the lock shifter comprises a first portion and a second portion, the first portion cooperating with the motor actuator, and the second portion having opposite locking faces and opposite unlocking faces, wherein the shifting beads constrain the lock hook to enable the electronic lock in the locked state when the lock shifter is driven to rotate by the motor such that the locking faces mate with the shifting beads, and the shifting beads are able to move towards the unlocking faces and disengage from the lock hook to enable pull-up of the lock hook to unlock the electronic lock when the lock shifter is driven to rotate by the motor such that the unlocking faces mate with the shifting beads.

3. The electronic lock of claim 2, wherein the second portion of the lock shifter has a widthwise size and a lengthwise size greater than the widthwise size, and the second portion further has at two ends thereof in a lengthwise direction end faces configured as the locking faces, and front and rear faces in a widthwise direction configured as the unlocking faces.

4. The electronic lock of claim 2, wherein the electronic lock comprises two shifting beads which are arranged on two opposite sides of the lock shifter, and the shifting beads are substantially at the same level as the second portion of the lock shifter.

5. The electronic lock of claim 2, wherein the motor actuator is provided with a motor actuator chamfer and a actuator transmission shaft, and the first portion of the lock shifter is provided with a lock shifter transmission element which mates with the actuator chamfer and the actuator transmission shaft so that movement of the motor is transmitted to the lock shifter through the motor actuator when the motor operates.

6. The electronic lock of claim 1, wherein the electronic lock further comprises a printed circuit board (PCB) mounted inside the lock body and electrically connected to the motor so as to control the motor to operate, wherein a travel switch for controlling rotation of the motor is provided on the PCB, and a trigger cooperating with the travel switch is provided at an end part of the lock hook, the trigger being able to trigger the travel switch when the lock hook moves downwards in place.

7. The electronic lock of claim 6, wherein the lock hook is substantially U-shaped with one side of the U-shape relatively longer, two end parts of the lock hook each being provided with a limiting groove in cooperation with one of the shifting beads to hold the lock hook in a locked position, wherein the trigger is arranged at the end part of the longer side.

8. The electronic lock of claim 7, wherein the end part of the longer side of the lock hook is further provided with a latching groove arranged below the limiting groove, the latching groove cooperating with the shifting bead when the lock hook moves upwards in place, thereby preventing the lock hook from being removed from the lock body.

9. The electronic lock of claim 1, wherein the lock body is provided with a motor mounting part, a motor actuator mounting part, a lock shifter mounting part, two shifting bead mounting parts and a torsion spring mounting part, wherein the motor mounting part is positioned in a middle lower part of the lock body, the motor actuator mounting part is positioned above the motor mounting part, the lock shifter mounting part is adjacent to the motor actuator mounting block, the two shifting bead mounting parts are disposed at substantially the same level on two sides of the lock shifter mounting part, and the torsion spring mounting part is positioned above the lock shifter mounting part.

10. The electronic lock of claim 1, wherein the lock body is provided with a plurality of password keys and a confirmation key with a light indicator, and wherein the electronic lock is configured to be unlocked by a mobile phone application or by pressing the keys.

11. The electronic lock of claim 10, wherein the electronic lock is unlocked by pressing the keys in the following sequence:

Step 1: pressing the confirmation key;

Step 2: pressing the password keys;

Step 3: pulling up the lock hook to unlock;

Step 4: pressing down the lock hook to lock.

12. The electronic lock of claim 11, wherein in Step 1, pressing the confirmation key causes to activate electronic elements of the electronic lock, and the password keys are deactivated after a predetermined period of time if Step 2 is not executed; in Step 2, the password keys are pressed in sequence, followed by pressing the confirmation key, the motor starts to operate to unlock the electronic lock if a password input is correct; then Step 3 is executed, otherwise the motor automatically locks the electronic lock after a predetermined period of time if Step 3 is not executed, wherein if the password input is incorrect, the confirmation key is required to be re-pressed, followed by pressing the password keys in sequence; if incorrect passwords are input consecutively for a preset number of times, the password keys are deactivated for a predetermined period of time.

13. The electronic lock of claim 11, wherein in Step 3, the electronic lock is unlocked after the lock hook is pulled up, and in Step 4, the motor automatically operates to lock the electronic lock after the lock hook is pressed down.

14. The electronic lock of claim 10, wherein the electronic lock is unlocked by the mobile phone application in the following sequence:

Step 1: starting the mobile phone application;

Step 2: pressing the confirmation key to activate electronic elements of the electronic lock, the electronic lock is operatively coupled with the mobile phone within a predetermined period of time if the mobile phone and the electronic lock are within communication range;

Step 3: after the operative coupling, the motor automatically operates to drive the electronic lock in a ready-for-unlocking state; or a tap at an unlock icon on the mobile phone application drives the electronic lock in the ready-for-unlocking state;

Step 4: pulling up the lock hook to unlock; the motor automatically locks the electronic lock after a predetermined period of time if the lock hook is not pulled up;

Step 5: pressing down the lock hook, and the motor automatically locks the electronic lock;

Step 6: the electronic elements of the electronic lock automatically enter an idle state after a predetermined period of time if the mobile phone application is closed, or Bluetooth is turned off, or the mobile phone and the electronic lock are not within the communication range.

15. A method of controlling light color of the electronic lock according to claim 1 useful to indicate present status of the electronic lock to a user, wherein the confirmation key is configured to emit blue, green or red light, wherein the blue light is on continuously, indicating that the electronic lock is locked;

the blue light is flashing, indicating that the electronic lock is waiting to be operatively coupled with a mobile phone or for a password to be pressed, or that the operative coupling is in progress;

the green light is on continuously, indicating that the electronic lock is in unlocking state but the lock hook is not pulled up;

the red light is on continuously, indicating that the electronic lock is unlocked with pull-up of the lock hook, or that excessive misoperation results in failure to unlock the electronic lock;

the red light is flashing quickly indicating that a password input is wrong;

the red light is flashing slowly, indicating that battery level is low and battery replacement is required.

* * * * *